US005424900A

United States Patent [19]

Kiiskinen et al.

[11] Patent Number: 5,424,900

[45] Date of Patent: Jun. 13, 1995

[54] ELECTRONIC AUXILIARY CONTACT FOR A CONTACTOR

[75] Inventors: Esko Kiiskinen; Petri Solanti; Erkki Rajala, all of Vaasa, Finland

[73] Assignee: ABB Strömberg Kojeet Oy, Vaasa, Finland

[21] Appl. No.: 955,754

[22] PCT Filed: Jun. 25, 1991

[86] PCT No.: PCT/FI91/00198

§ 371 Date: Dec. 24, 1992

§ 102(e) Date: Dec. 24, 1992

[87] PCT Pub. No.: WO92/00599

PCT Pub. Date: Jan. 9, 1992

[30] Foreign Application Priority Data

Jun. 26, 1990 [FI] Finland ..... 903195

[51] Int. Cl.[6] ..... H01H 50/00

[52] U.S. Cl. ..... 361/116; 335/132

[58] Field of Search ..... 200/50 R, 50 AA, 50 C; 335/132; 307/116, 119, 125, 139

[56] References Cited

U.S. PATENT DOCUMENTS

| | | | |
|---|---|---|---|
| 345,225 | 8/1982 | Lemmer | 335/132 |
| 3,270,164 | 8/1966 | Schubring | 335/103 |
| 3,388,353 | 6/1968 | Isler | 335/132 |
| 4,236,149 | 11/1980 | Soyck | 340/644 |
| 4,467,300 | 8/1984 | Harbauer | 335/131 |
| 4,757,213 | 7/1988 | Tiggs et al. | 307/116 |
| 4,945,256 | 7/1990 | Tada et al. | 307/139 |
| 5,189,789 | 3/1993 | Taylor | 335/132 |

*Primary Examiner*—Jeffrey A. Gaffin

[57] ABSTRACT

An electronic auxiliary contact for a contactor has at least one switch element controllable to the conducting and non-conducting states for the purpose of indicating the position of the contact bridging member in the contactor, and a switch-activating element mechanically connected to the contact bridging member and capable of activating the switch element. The switch-activating element incorporates at least one activating element, and the switch-activating element makes no mechanical contact with the switch element. The system provides a reliable method of monitoring the operation of a contactor.

4 Claims, 4 Drawing Sheets

ELECTRONIC AUXILIARY CONTACT FOR A CONTACTOR

FIELD OF THE INVENTION

The present invention relates to an electronic auxiliary contact for a electromechanical contactor having a movable slider and at least one switch element.

DESCRIPTION OF THE BACKGROUND ART

Conventional contactors employ mechanical auxiliary contacts according to FIG. 1 to accomplish different kinds of control and monitoring signals. The contact block is constructed with the help of a moving contact element a attached to the contact bridging member, said element carrying a portion of the circuit b of the auxiliary contact, said portion opening and closing the circuit c when said contact element is in either of its home positions. The contacts are sprung to attain longer mechanical life.

A mechanical contact is suitable for controls performed at conventional mains voltage levels, but developments in automation technology have set new demands on the quality of control and monitoring signals. Low voltage level and small current as well as precise timing of the signals are now desirable. Information on the position of a contactor's contact bridging member, for instance, can be signalled by means of mechanical auxiliary contacts, but this prior-art technique involves problems that compromise the reliability of obtained information. Bouncing of contacts at the opening and closing generates signal transients which cause jitter in the precise timing of events, and due to the mechanical play of contacts, the timing of the obtained signal has insufficient accuracy for positional monitoring of the contact bridging member. Moreover, contamination and oxidation of contact surfaces cause malfunctions, particularly at low current and voltage levels.

SUMMARY OF THE INVENTION

It is an object of the present invention to overcome the above-described disadvantages and to achieve a novel system for obtaining and utilizing information on the positions of a contactor.

The system according to the present invention is based on the idea that the actuating element of the auxiliary contact operates without mechanically contacting the actual switch body of the auxiliary contact.

More specifically, the auxiliary contact according to the invention is characterized by a switch-activating element which incorporates at least one activating element and makes no mechanical contact with the switch element.

An electronic auxiliary contact according to the invention offers substantial benefits with respect to the conventional technology. Thus, a stable signal is obtained from the position of the contact bridging member, contact bouncing transients are avoided and the timing precision of the positional information is jitter-free. Due to the hermetic protection of the switch element, the characteristics of the auxiliary contact are not deteriorated by contamination or oxidation. The electronic auxiliary contact has no moving parts thus retaining a constant timing precision of the positional information even in extended use, and isolation problems are relieved by the mechanically noncontacting nature of the auxiliary contact switch circuit in respect to the moving pans.

The electronic auxiliary contact can provide reliable positional information for a process control computer also from a circuit operating at a low supply voltage. The position of the contactor's contact bridging member can be determined with an extremely high precision. The electronic auxiliary contact has a simple construction, and by integrating more electronics to it, possibilities of multiple different monitoring function are feasible not ever attainable at a sufficient accuracy by means of a mechanically operating auxiliary contact. A single auxiliary contact block can incorporate one or more position sensors, thus making it possible to detect various intermediate positions complementing the conventionally indicated home positions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with the help of the attached drawings and exemplifying embodiments illustrated therein which are given by way of illustration only and thus are not limitative of the present invention.

DETAILED DESCRIPTION OF THE PREFERRED EMBODIMENTS

Figure 1:
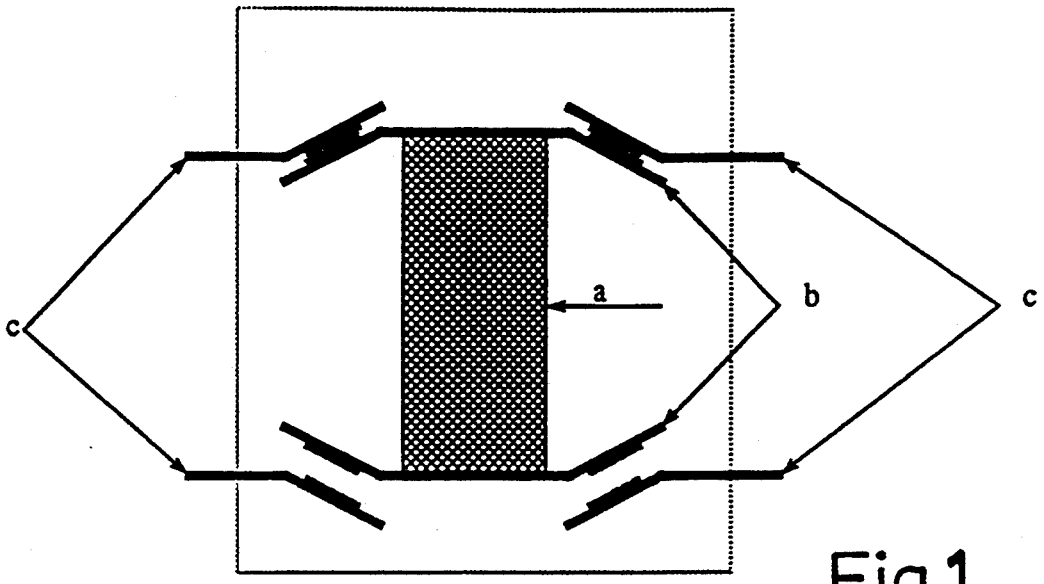
Fig.1 PRIOR ART
FIG. 1 shows a conventional auxiliary contact in a side view.
Figure 2:
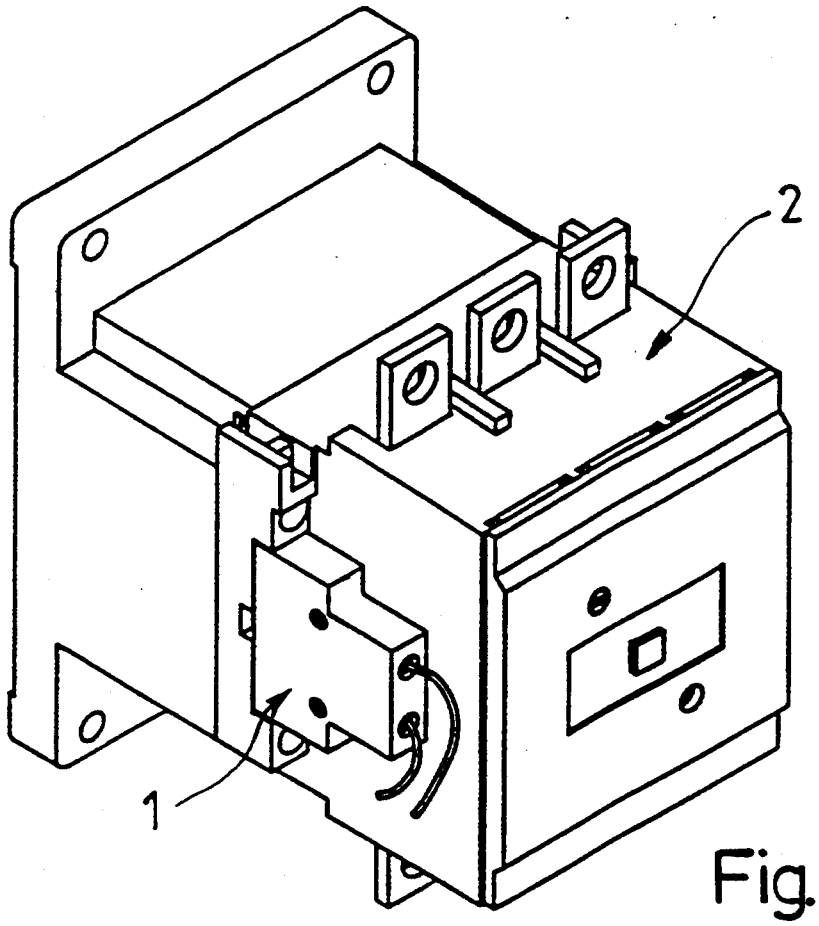
FIG. 2 shows a perpective view of an auxiliary contact according to the invention attached to a contactor.

According to FIG. 2, the contactor's auxiliary contact block 1 is fastened to the body 2 of the contactor. According to FIG. 3, the auxiliary contact block is comprised of a two-part body block 4 and an oblong slider 3, which is situated inside the body block 4 and is guidedly movable along a groove 5. The slider 3 incorporates a peg 8 aligned to one end of the slider perpendicularly to the longitudinal axis of the slider. The peg 8 is oriented toward the inner side of the contactor 2. Thus, the auxiliary contact block 1 is fastened by fitting the peg 8 of the slider 3 to the contact bridging member (not shown) of the contactor 2. The slider 3 is moved along the groove 5 exactly by the same distance as the contact bridging member of the contactor 2 moves between its upper and lower home positions. The position of the slider 3 is detected by sensors 6 and 6' which are permanently mounted to the body block 4 of the auxiliary contact block 1, whereby said sensors in the described embodiment are Hall sensors. Alternatively, the sensors can be replaced by inductive or capacitive proximity sensors or optical gap sensors. Magnetically-activated switch contacts are also feasible as sensors, but they do not offer as good precision as is attainable with the other sensor types described above. One auxiliary contact block 1 requires two sensors 6 and 6'; one sensor serving for the upper and one for the lower home position, respectively. The functions of a single-position mechanical auxiliary contact can be accomplished using a single sensor alone.

Figure 3:
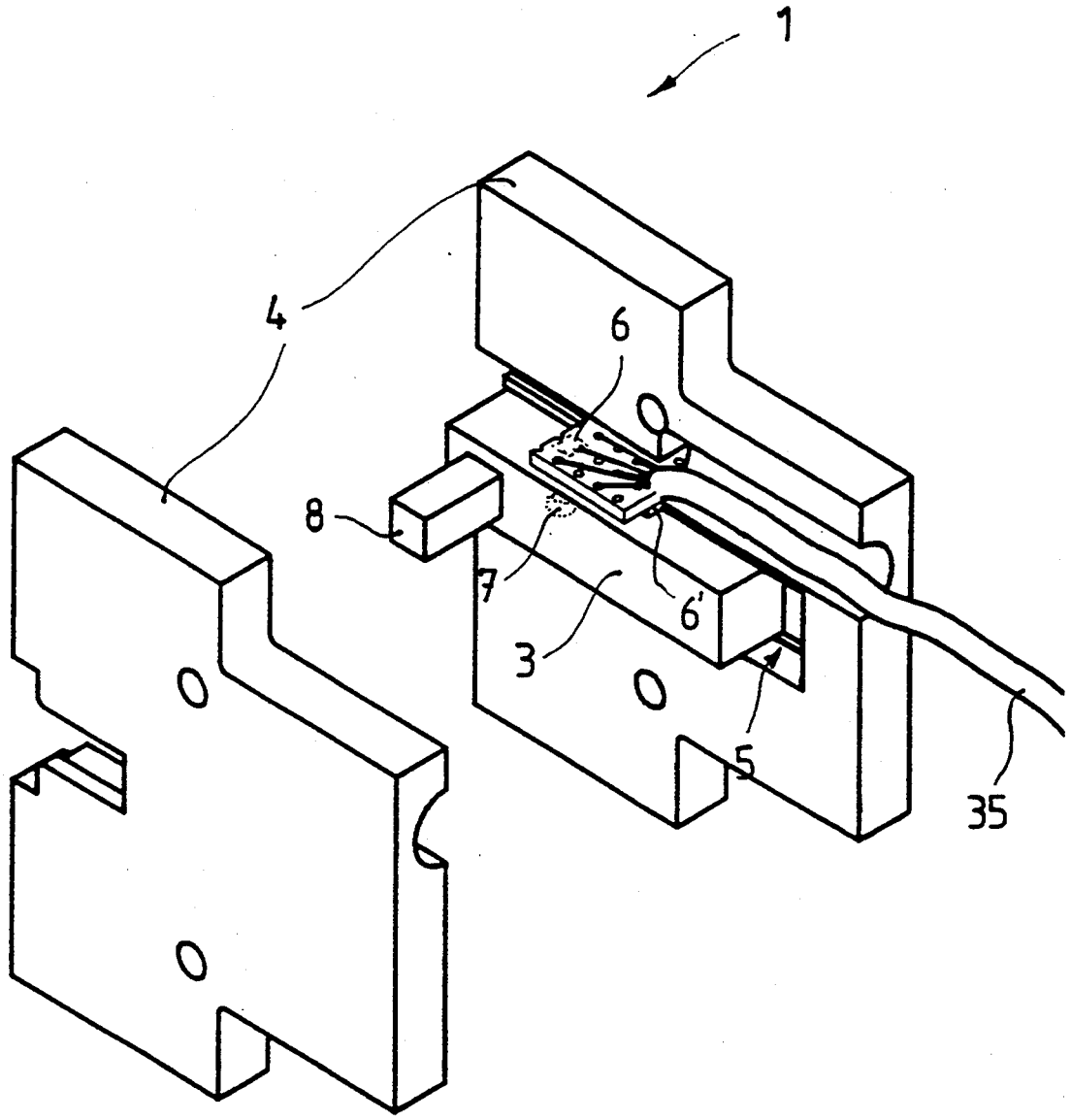
FIG. 3 shows a sectional view of an embodiment of the auxiliary contact according to the invention illustrated in FIG. 2.

FIG. 3 illustrates a construction having two sensors 6 and 6', whereby said construction is capable of replacing a dual-function mechanically switched contact. The sensors 6 act as switch elements and are placed on the upper surface of the slider 3. Because the sensors 6 and 6' are of the Hall sensor type, a small permanent magnet 7 is fastened to the slider 3, whereby the motion of the magnet to coincide with the sensor 6 or 6' sets the respective sensor to the conducting state. This arrangement makes it possible to adjust the effective stroke of the slider and the activation positions of the sensors by varying the size of the magnet 7 and the mutual distance of the Hall sensors 6 and 6'. Because the Hall sensors 6 and 6' will only be activated by a magnetic flux aligned perpendicular to their measuring surface, it is possible to select a suitable sensor/magnet combination and align these elements appropriately with respect to the flux emitted by the main magnetic circuit of the contactor 2 so that an extremely accurate sensor function, free from interference by stray fields, is achieved. The signals from the sensors 6 and 6' are taken in a cable 35 to a signal processing unit to be described below; thus, an embodiment based on Hall sensors requires a cable with three separate conductors, one for each Hall sensor element. In practice the number of conductors is increased to the qty. of sensors plus two, because each sensor element needs a separate signal line complemented with a common ground and supply voltage line. Therefore, the number of conductors necessary in the described embodiment is 4.

Figure 4:
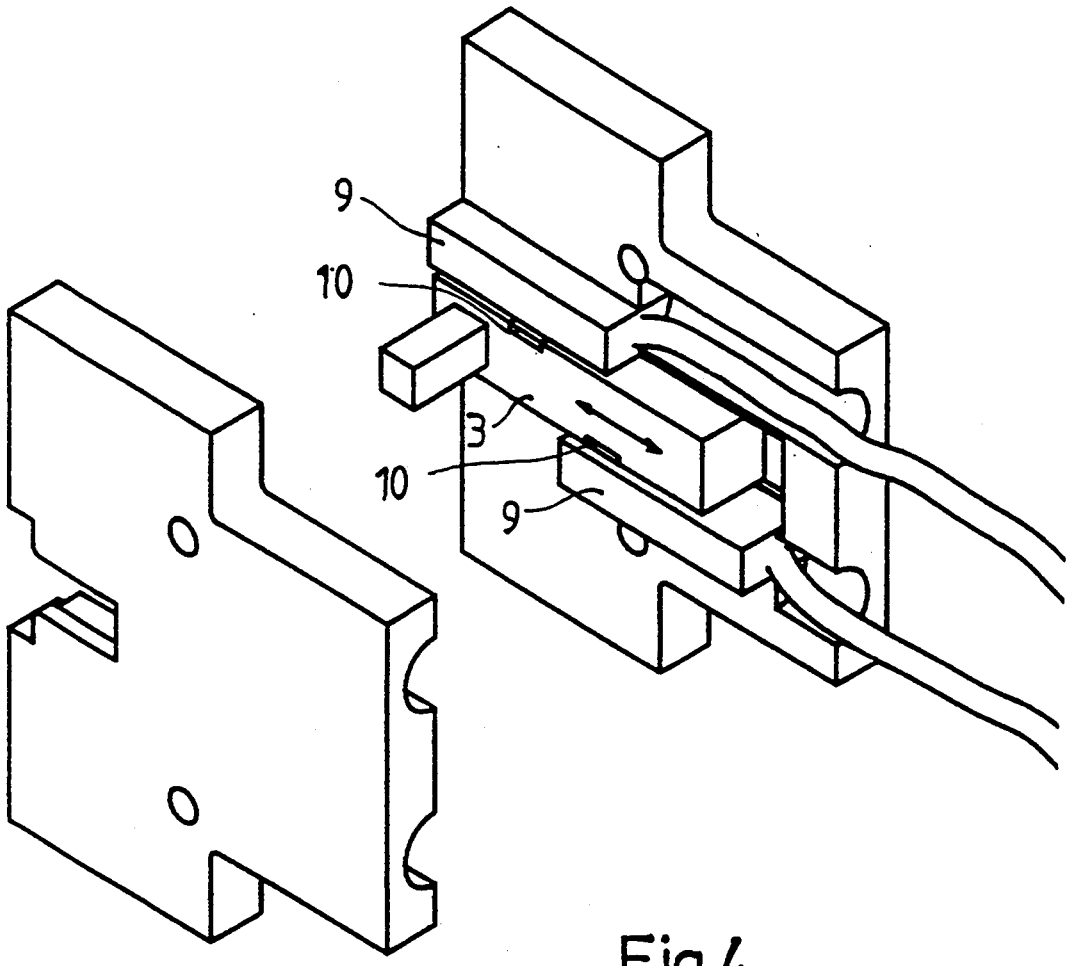
FIG. 4 shows an alternative embodiment of an auxiliary contact according to the invention in a perspective view.

FIG. 4 shows a corresponding construction suitable for inductive or capacitive sensors 9. The mechanical basic construction herein is similar to that described for the embodiment illustrated in FIG. 3, so two sensors 9 are also needed in this embodiment. This kind of sensors 9 can operate without an external magnetic flux, because they sense the proximity of a metallic vane 10 in front of their sensing surface. Therefore, the slider 3 is provided with small metal plates 10 which are aligned with respect to the sensors 9 so that one plate is coincident with the upper position sensor when the contact bridging member is in its upper home position and, correspondingly, the other plate is coincident with the lower position sensor when the bridging member is in its lower home position.

The mechanical design of the auxiliary contact block can vary for different types of contactors, yet maintaining an identical principle of operation.

An electronic auxiliary contact operates at a low supply voltage of 5–48 VDC depending on the sensor type used. Hall sensors as well as inductive, capacitive and optical sensors require a separate supply voltage line and a dedicated signal line. Maximum allowable load current from the sensor output stages is limited to a few tens of milliamperes at its best, so an electronic power driver stage or relay is necessary for controlling voltages or currents at higher levels. In most applications the operating environment tends to cause interference with the measurement, so the output signal from the sensor elements must be processed by electronic means in either the sensor block, its immediate vicinity or the automation system.

Figure 5:
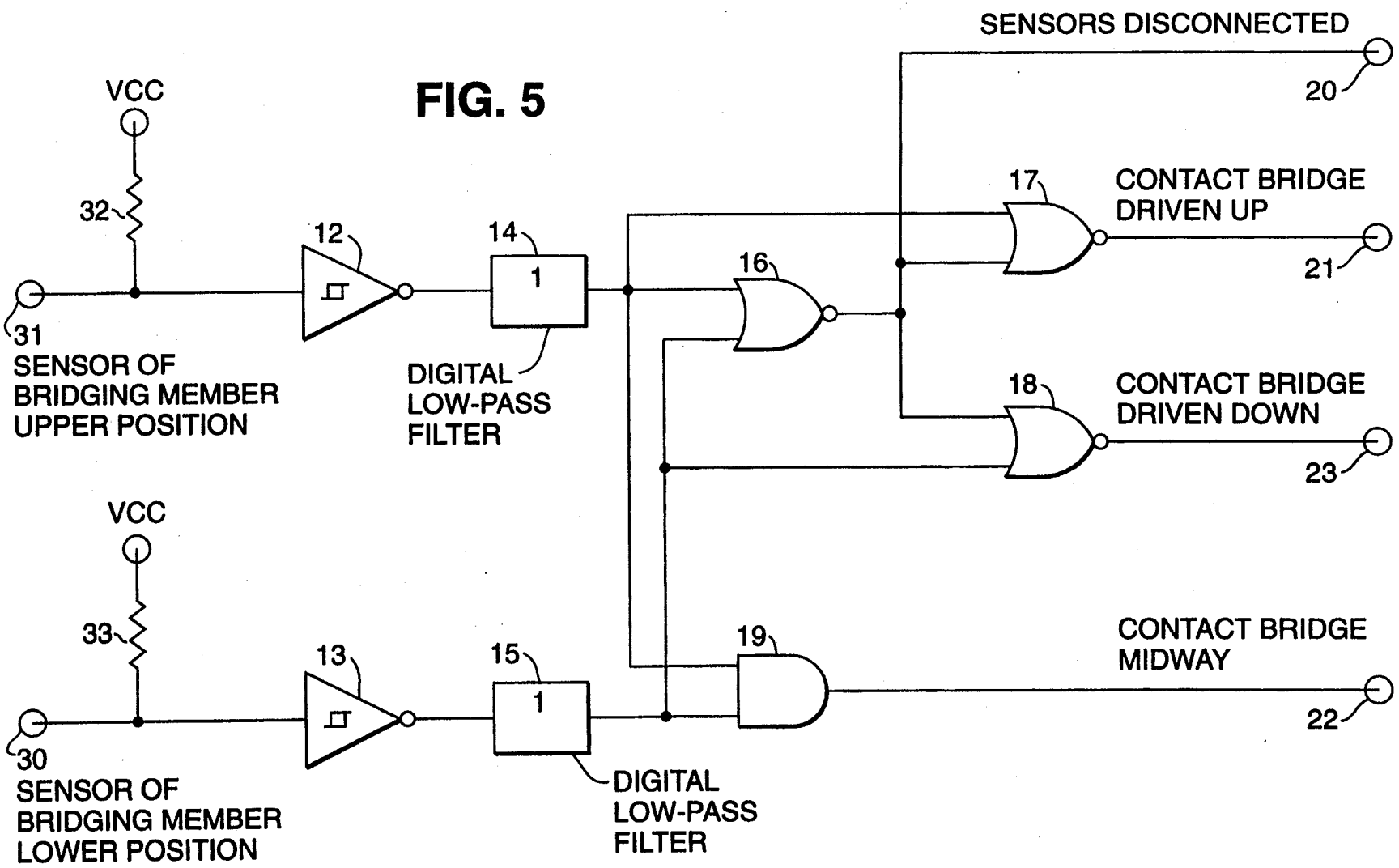
FIG. 5 shows a block diagram of the signal processing block of an auxiliary contact according to the invention.

An application of the electronic auxiliary contact is in contact bridging member position monitoring of contactors. The contactor's electronic auxiliary contact block having separate sensors for the upper and lower home position sensing is connected to a logic circuit shown in FIG. 5. The logic circuit comprises inputs for a lower-position sensor signal 30 and an upper-position sensor signal 31, inverting Schmitt triggers 12 and 13, distal low-pass filters 14 and 15, and a positional information processing logic circuitry comprised of three NOR gates 16, 17 and 18, and one AND gate 19. The logic circuitry processes input signals taken to the inputs 30 and 31 into four different state-indicating signals defined as: Signal "Sensors disconnected" 20, signal "Contact bridge driven up" 21, signal "Contact bridge midway" 22 and signal "Contact bridge driven down" 23.

In severe operating conditions the input signals will carry superimposed interference consisting of mains frequency, harmonics or high-frequency transients caused by frequency converters and other switch-mode power sources. The Schmitt triggers 12 and 13 at the logic inputs filter away low-amplitude interference from the input signals irrespective of their frequency. The filtration result will be the more effective the wider the hysteresis of the Schmitt trigger 12 or 13. Further improvement in filtration can be obtained by using a large input voltage swing. The inputs are taken high by pull-up resistors 32 and 33 for the purpose of sensing the integrity of sensor connections.

At the second stage the interference components managing to pass the Schmitt triggers 12 and 13 are filtered away by one-bit digital filters 14 or 15. The filter 14, 15 can be a median-producing filter or a nonlinear low-pass filter that removes transients from the signal.

The logic circuit described above for processing of positional information is implemented for detection of a sensor 6 in the conducting positions and an activated sensor is in the non-conducting position. If neither of the sensors 6 is activated, that is, both of their output signals are taken as being low, the contact bridging member is interpreted to be in a midway position. Signal indicating this state is formed by the AND gate 19. A situation having both sensors 6 activated is considered impossible, so its occurrence can be interpreted to indicate severed connection to the sensors. Signal indicating this state is formed by NOR gate 16. When Hall sensors are employed, their output signal properties must be considered in the placement of the sensors. Signals "Contact bridge driven up" and "Contact bridge driven down" are formed by NOR gates from the input signals 30 and 31, complemented with the signal "Sensors disconnected" 20.

Several auxiliary contact blocks 1 can be connected in parallel, which in larger contactors offers a possibility of detecting contact bridging member jamming slantingly that generally is indicative of contact welding. Information on contact bridging member position can be employed even in a wider scale for controlling a contactor. For instance, the position state signals can be utilized to monitor contactor opening during hold and then to activate necessary functions to re-establish contactor hold.

Any of the discussed sensor types are suitable for use with the above-described circuitry provided that they incorporate an open-collector output stage capable of driving the logic circuitry sensor inputs to a logic zero state.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic auxiliary contact for a contactor, said auxiliary contact comprising:

movable slider mechanically connected to a contact bridging member for following change of position of the contact bridging member;

at least one switch element cooperating with the slider for moving between conducting and non-conducting positions for indicating the position of the contact bridging member in said contactor; and at least one activating element for activating said switch element, the at least one activating element being incorporated in the slider;

said slider failing to make mechanical contact with said at least one switch element.

2. The auxiliary contact as defined in claim 1, wherein said activating element is a permanent magnet and said switch element is a Hall sensor.

3. The auxiliary contact as defined in claim 1, wherein said activating element is a piece of material having a metallic character and said switch element is an inductive sensor.

4. The auxiliary contact as defined in any of the foregoing claims, wherein the switch outputs a signal triggered by said activating elements, said auxiliary contact incorporates a signal-processing unit for elimination of interference and processing of information related to the position of said contact bridging member of said contactor.

* * * * *